US005749471A

United States Patent [19]

Andersson

[11] Patent Number: 5,749,471

[45] Date of Patent: May 12, 1998

[54] VIBRATING SCREEN

[75] Inventor: Anders Andersson, Arbrå, Sweden

[73] Assignee: Svedala-Arbra AB, Arbra, Sweden

[21] Appl. No.: 545,814

[22] PCT Filed: Apr. 28, 1994

[86] PCT No.: PCT/SE94/00380

§ 371 Date: Nov. 7, 1995

§ 102(e) Date: Nov. 7, 1995

[87] PCT Pub. No.: WO94/26427

PCT Pub. Date: Nov. 24, 1994

[30] Foreign Application Priority Data

May 10, 1993 [SE] Sweden ..... 9301592

[51] Int. Cl.[6] ..... B07B 1/28

[52] U.S. Cl. ..... 209/314; 209/315; 209/319; 209/329; 209/341; 209/354; 209/355; 209/366.5

[58] Field of Search ..... 209/314, 315, 209/319, 329, 341, 344, 354, 355, 367, 366.5, 402, 404

[56] References Cited

U.S. PATENT DOCUMENTS

| | | | |
|---|---|---|---|
| 2,386,579 | 10/1945 | Wheeler | 209/314 |
| 2,600,508 | 6/1952 | Lehman et al. | 209/354 |
| 2,775,347 | 12/1956 | Weston | 209/314 |
| 2,853,191 | 9/1958 | Mogensen . | |
| 4,655,907 | 4/1987 | Ando | 209/404 |
| 4,855,039 | 8/1989 | Genev . | |
| 5,337,901 | 8/1994 | Skaer | 209/315 |

FOREIGN PATENT DOCUMENTS 1044061 11/1953 France .

*Primary Examiner*—David H. Bollinger
*Attorney, Agent, or Firm*—Beveridge, DeGrandi, Weilacher & Young, L.L.P.

[57] ABSTRACT

A vibrating screen for the sizing of granular material such as gravel, sand, crushed stone, etc., having a frame (1) and a screen body (2) supported on springs (6), directional oscillating movements being imparted to the screen body by a motor powered vibrator mechanism (3). The screen has two or more screen decks (11–13), each one divided into three component screens (14*a–c*, 15*a–c*, 16*a–c*) having successively decreasing inclinations in a direction towards the discharge end (9) of the screen, each lower screen deck furthermore having an increased inclination in relation to the nearest deck above.

12 Claims, 3 Drawing Sheets

VIBRATING SCREEN

This invention relates to improvements in a known type of vibrating screen for sizing granular materials such as gravel, sand, crushed stone, etc., in which an oblong screen body is movable in relation to a frame by a motor powered vibrator mechanism which is connected to the screen body. In these known screens, oscillating movements are imparted to the screen body by the vibrator mechanism; there is an upper screen deck and one or more lower screen decks; there are successively decreasing screen openings for each lower deck; the decks are inclined downward from the feed end toward the discharge end; each screen deck is composed of a plurality of component screens arranged one after the other; each component screen is provided with a screening element such as metal wire cloth or netting; and, the component screens are arranged with successively decreasing inclinations relative to the horizontal plane.

OBJECT OF THE INVENTION

The objects of the present invention are to obtain a vibrating screen which, under limitation of its dimensions and weight, has a high capacity and makes it possible to produce a plurality of accurately separated product fractions and which also, due to the mentioned limitations, has a low acquisition cost and is easy to transport.

In brief, the stated objects have been attained by fitting the vibrating screen in accordance with the invention with a vibrator mechanism with a directional throw in combination with a specific arrangement of the inclination of the different screen decks, in addition to which a width-saving tensioning of the screen cloths or nettings is made possible by means of a specific tensioning arrangement.

BACKGROUND

In crushing and screening plants, for example for the production of concrete ballast or asphalt material, the development has gone towards increasing capacity demands in combination with demands for the production of accurately sized, short product fractions, i.e. fractions having a small span between the upper and lower fraction limits. A typical example of such fractions, and of an application of the vibrating screen in accordance with the present invention, is the dividing of a feed material 0–16 mm into the fractions 0–4, 4–8, 8–11.2 and 11.2–16 mm. An additional typical prerequisite is that the capacity of the screen should be at least 150–200 metric tons per hour and, furthermore, that it should be easily portable in order to make it possible also to exploit smaller material deposits in an economical way. For the last-mentioned prerequisite, in addition to the transportability and, thereby, the transport cost, the acquisition cost of the screen is also of importance.

Even discounting the demand for transportability, it is a great advantage to be able to keep the dimensions of the screen as small as possible. Large and heavy screens with large vibrating masses imply severe strains on the screen body and require a meticulously correct dimensioning and balancing of same. Furthermore, heavily dimensioned bearings are required for the vibrator mechanism, which bearings cannot endure a high speed, i.e. a high stroke frequency of the vibrating movement. The acceleration or throwing effect on the material to be screened is thereby impaired. Furthermore, the screens are of course more expensive in acquisition and require more energy for their operation.

A typical example of a screen in accordance with the invention which is adapted to the above-mentioned production prerequisites is a multideck screen having an effective width of the screen decks of 1800 mm and an effective length of same of 3300 mm. Even larger width and length measures can come into the question for the obtaining of higher capacities.

It is known earlier to divide a screen deck into a plurality of component screens having a successively decreasing inclination in the direction towards the discharge end of the screen. This arrangement results in different transport speeds of the material to be screened along the different component screens, which is advantageous for the screening efficiency. A fast moving away of the material to be screened is required at the first portion of the screen deck where it has to handle a large amount of material, as otherwise the bed of material will be too thick for the undersize particles in its top layer to be screened through. Towards the middle and final portions of the deck, the bed of material is thinned out, and the transport speed can be lowered so that the material particles are thrown up and fall down a large number of times during their transport, the undersize particles thereby getting increased chances of passing through the screen openings. With sucessively reduced inclinations, the total height of the screen is, in addition, reduced, the total length of the screen decks at the same time being maintained. In the vibrating screen in accordance with the invention, this deck arrangement has been utilized in a partly new way, as will be described more closely hereafter.

The vibrating screen in accordance with the invention is in each screen deck fitted with three component screens having a successively decreasing inclination. For the tensioning of the screening elements—which can be for example metal wire cloths, wire nettings or plastic cloths provided with apertures—end tensioning has been chosen, i.e. they are tensioned in the longitudinal direction of the screen. This results in the smallest possible loss of effective internal width, so that the width of the screen can be kept down. It also makes it possible to use long-mesh wire nettings or cloths, i.e. cloths having oblong, rectangular screen openings which have a width at right angles to the feed direction which corresponds to the size of the desired product fraction, but which have a length considerably greater than the size of the fraction. Side tensioning, which is another common tensioning method, results in a considerable loss of effective width, since space-requiring tensioning elements are added inside the side plates of the screen, and would therefore require an increased total width to obtain the required effective width. In addition, side tensioning makes it difficult or impossible to use long-mesh screen cloths, the wires to be tensioned in the lateral direction being too few and spaced too widely apart to give the cloth the required firmness.

An end-tensioned deck with two component screens constitutes no particular problem in connection with the replacement and tensioning of the screening elements, since these are accessible from each end of the screen body. For the arrangement chosen in accordance with the invention, however, the middle one of the three component screens in each deck constitutes a problem which is solved with the help of a specific device which is described in closer detail hereafter.

DESCRIPTION OF THE ATTACHED DRAWINGS

Figure 1:
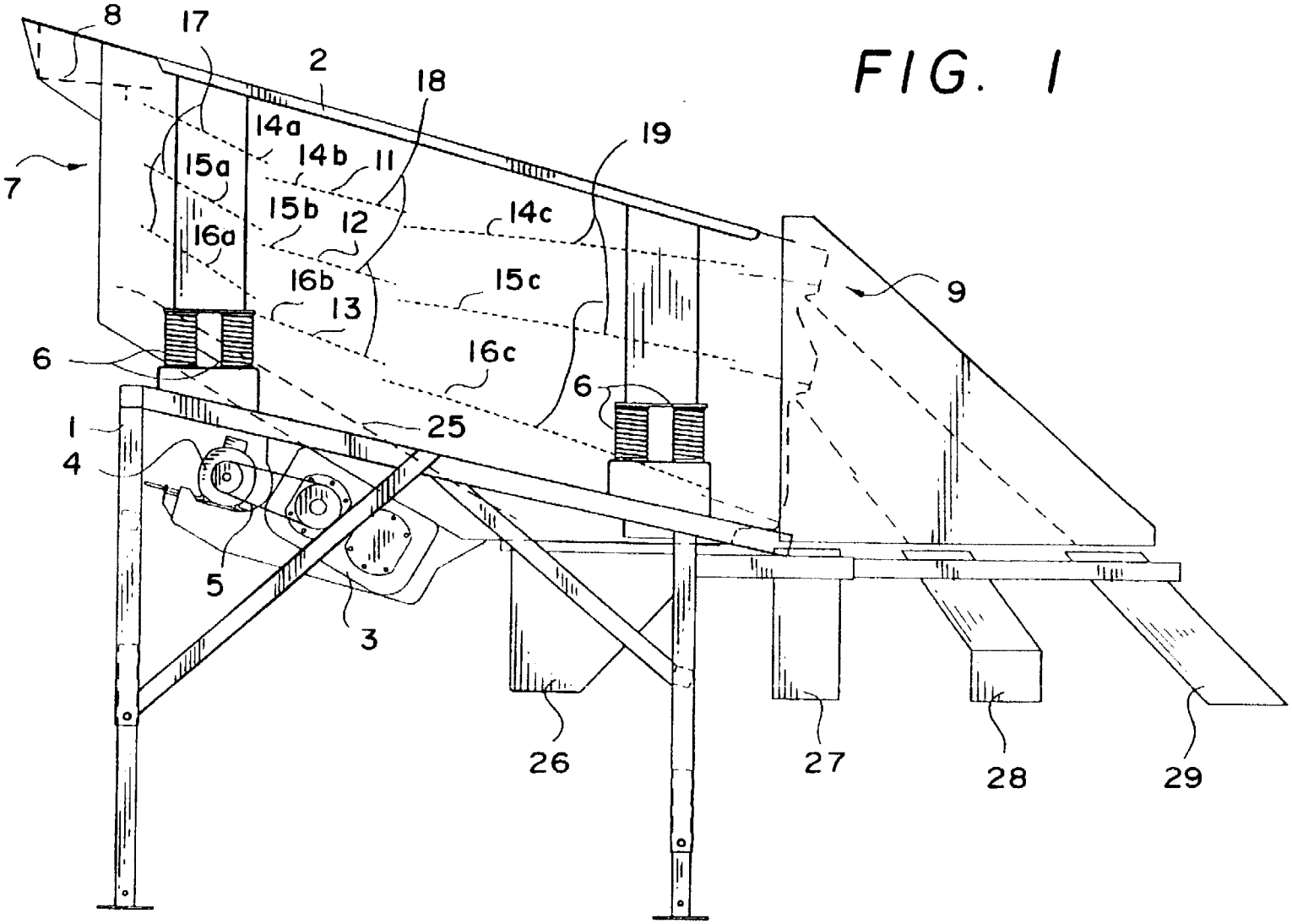
FIG. 1 shows a side view of a vibrating screen in accordance with the invention which is supported on a frame and fitted with slides or guide chutes for collecting the material fractions produced.

For the sake of lucidity, a number of parts have been left out which are not essential for the understanding of the invention, such as support frames for supporting the screen decks, seals between the screening elements and the sides of the screen body, stiffeners, etc.

DESCRIPTION OF AN EMBODIMENT OF THE INVENTION

The vibrating screen in accordance with the invention comprises a frame or stand 1, a screen body 2 and a vibrator mechanism 3 fitted on same and having an electric motor 4 and a V-belt drive 5. The mechanism is of the twin-shaft type having off-centre weights fitted on the shafts which weights, in a known way, co-operate in two opposite directions and counteract each other in all other directions, thereby producing a mainly linear reciprocating movement. This movement is transmitted to the free-swinging screen body which is supported on springs 6. The springs are supported on the frame 1.

The screen in accordance with the embodiment of the invention shown in FIG. 1 is driven by two motors and two V-belt drives driving one each of the two vibrator shafts. In the figure, however, only one motor and V-belt drive are visible, the other pair being obscured. When the screen is driven in this way, the movements of the two vibrator shafts are automatically synchronized by the effect of the off-centre weights. It is also possible to use only one motor to drive one of the vibrator shafts which by means of a spur gearing drives the other shaft.

Figure 2:
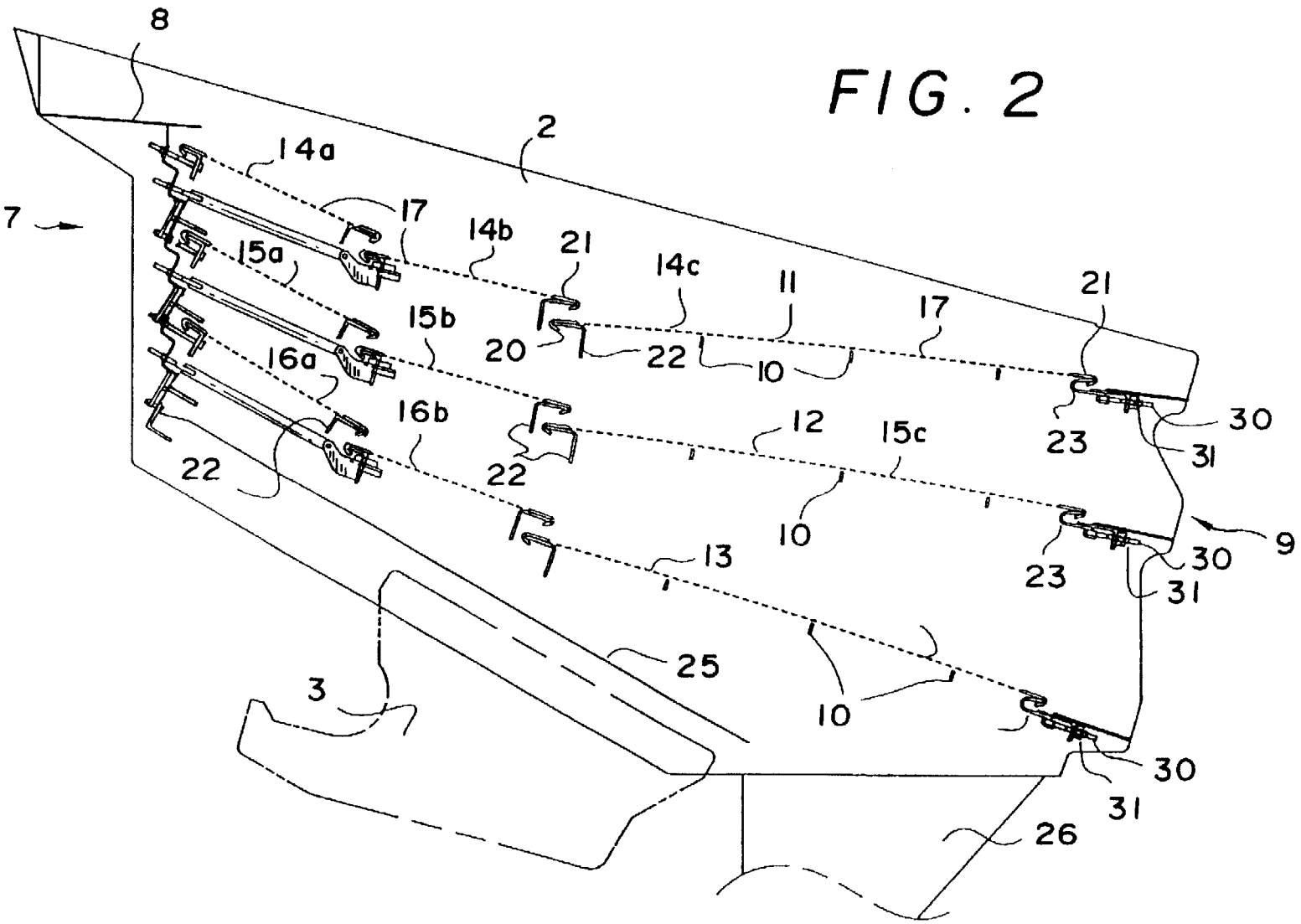
FIG. 2 shows a strongly diagrammmatic, partly sectioned side view of the screen body only, without frame and chutes.
Figure 3:
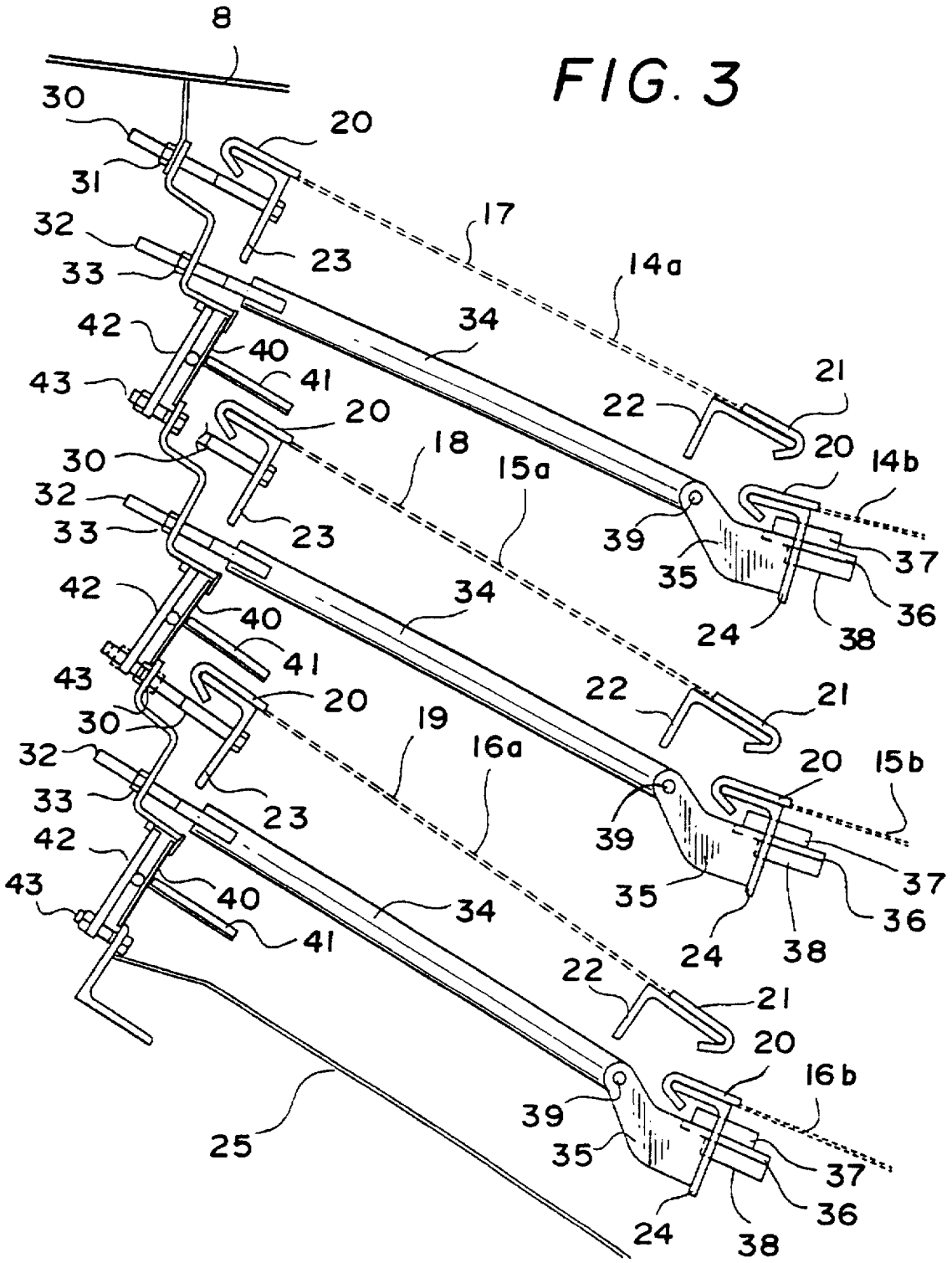
FIG. 3 is a partial enlargement, comprising the infeed end of the screen, of the view in accordance with FIG. 2.

At the feed end 7 of the screen body, a feed plate 8 without screen openings is provided for the reception and distribution of the feed material. The opposite end of the screen body, the discharge end, is designated by the numeral 9. The screen is provided with three screen decks 11–13 arranged one above the other and each one consisting of three component screens 14*a–c*, 15*a–c*, 16*a–c*. Each component screen comprises a screening element 17–19, not shown in detail, such as a metal wire cloth or netting provided with meshes, said screening elements being fitted with hook strips 20, 21 at both ends. The hook strips are at one end of the screening element hooked on to fixed holders 22 and, at the opposite end, to movable tensioning irons 23 and 24, respectively. In FIG. 2 only a few of the just mentioned parts 20–24 have been designated by numerals, as otherwise the figure would become too confused.

The vibrator mechanism 3 is protected from the screened material falling down by an unperforated plate 25 which leads the material passing through tne bottom screen deck to a chute or slide 26. The other material fractions are collected and led away by chutes or slides 27–29.

The chosen end tensioning of the screening elements presents a problem as regards the middle component screen in each deck. The component screens 14*a*, 14*c*, 15*a*, 15*c*, 16*a*, 16*c*, which are directly accessible from the ends of the screen body, can be fitted with tensioning irons 23 which in direct connection are provided with tensioning screws 30 having nuts 31. The tensioning screws can be so located that they provide for a direction of pull which corresponds to the desired tensioning direction of the screening element, i.e. to its inclination relative to the horizontal plane. For the middle screens 14*b*, 15*b*, 16*b* in each deck, the tensioning of the screening elements cannot be carried out in the same simple way. To solve the problem of tensioning these screening elements, the tensioning screws for same have therefore, in accordance with the invention, been moved to the feed end of the screen body where they are easily accessible, and are in each deck located below the tensioning screws of the outer component screen in the same deck, i.e. in the space between these screws and the tensioning screws of the nearest deck below. This means that the point of operation of the tensioning device at the end of the deck is not at the correct height to correspond to the desired tensioning direction. For the middle screening elements, tensioning screws 32 are therefore provided, each one being flexibly connected to a tensioning slide 35 by means of an extension rod 34. The slide is provided with guide irons 36 which are guided in the desired tensioning direction by guides 37, 38 welded to the side of the screen body. The movable tensioning iron 24, which extends substantially across the total width of the component screen, is at least at each one of its two ends fixedly connected to a tensioning slide 35 and is hooked on to the tensioning strip 20 of the screening element. The point of articulation at which the pulling force acts on the tensioning slide is located a little lower than the point of engagement between the tensioning iron 24 and the tensioning strip 20. This is in order to obtain a force which strives to turn the tensioning slide in such a way that its rear end moves downwards and its front end upwards. The turning force causes the guide iron 36 of the tensioning slide to press against the guides 37, 38, so that the vibrating movements of the screen cannot make the guide iron hammer against the guides and cause a successively arising play.

At the feed end of the vibrating screen, covers 40 are provided in order to prevent spillage of material through it, which covers can be removed to provide accessibility for the replacement of screening elements. The covers also support spillage protection plates 41 which prevent the spillage of material down to the deck below between the covers and the ends of the screening elements. The covers are clamped in place by retaining irons 42 which are secured by screws 43 provided with nuts.

The three component screens in each screen deck are arranged with an inclination which successively decreases towards the discharge end of the screen. Furthermore, the arrangement is such that each component screen in a lower deck is somewhat more steeply inclined than the corresponding component screen in the next deck above it, i.e. the component screen which is located substantially vertically above the component screen of the lower deck. The different inclinations have been chosen with regard to obtaining for each deck the optimum thickness of the bed of material and the optimum transport speed of it towards the discharge end of the deck in order to obtain, thereby, at all points along the decks, a high processing capacity while retaining a high screening efficiency. The target of the choice of inclinations is to obtain, at the beginning of each deck, a bed thickness of approximately twice the screen opening size, which is a suitable bed thickness for the attaining of both a high capacity and a good screening efficiency, and to maintain also for the following component screens a bed thickness corresponding to or slighty lower than the just mentioned measure. This is achieved thereby that the chosen inclinations provide for a correctly adjusted transport and distribution of the bed of material at all points along the decks in relation to the quantities of material and the sizes of the screen openings at the respective points.

In combination with this arrangement, the vibrating screen is furthermore, in order to obtain a controlled feeding movement of the material to be screened, provided with a vibrator mechanism of the type which produces a substantially linear reciprocating movement resulting in a throwing effect on the material particles directed obliquely upwards and forwards in a direction towards the discharge end of the screen. The predetermined direction of throw in combination with the choice of a suitable frequency and amplitude of the movement produced by the vibrator mechanism makes it possible to calculate and maintain an optimum transport speed of the material in relation to the inclinations of the decks, so that the material particles are lifted up and lowered a sufficient number of times for the undersize particles to be caught by the screen openings and pass through them.

In order to increase the capacity of the screen even further while maintaining an accurate sizing, the component screens of each screen deck are arranged in steps, i.e. the end portions of adjoining component screens are located at a vertical distance from each other. The material bed transported along a screen deck is thereby subjected to a turnover movement when passing from one component screen to the next-following one. In order to eliminate the risk of material passing through the gap between the edges of the component screens, the component screens overlap each other a distance in the horizontal plane.

Of the three component screens in each deck, the last one—designated c—is longer than the two other screens. It is therefore, in order to be held in place without "flapping", tensioned to form an arch over support irons 10. Such support irons are not shown for the shorter component screens, but can come into the question for these, too, depending on how long they are made. By dividing the first half of the screen decks, as shown, into two component screens with different inclinations, a quick distribution and coarse sizing of the material is obtained on the first screen, on the second one a slightly reduced transport speed and a more accurate screening out of particles from the now thinned-out bed of material and on the third, long component screen a still lower transport speed and the final sizing of the material. This three-stage screening in combination with the choice of different lengths of the component screens provides for a considerably higher capacity, while maintaining a good screening efficiency, than if the deck should only be divided into two component screens with different inclinations or, alternatively, have the same inclination all the way.

The embodiment of the invention shown and described is only an example, and variations of the design are possible within the scope of the claims.

What is claimed is:

1. A vibrating screen for the sizing of granular material, comprising a frame (1) and an oblong screen body (2) which is movable in relation to said frame, oscillating movements to be imparted to said screen body by means of a motor powered vibrator mechanism (3) connected to said screen body, said screen body being at one end, the feed end (7), arranged to receive unscreened material and furthermore being provided with an upper screen deck and one or more underneath said upper deck located lower screen decks (11–13) provided with successively decreasing screen openings for each lower deck, the decks being inclined downwards from said feed end (7) towards an opposite end of said screen body, the discharge end (9), and each screen deck being composed of three or more component screens (14*a–c*, 15*a–c*, 16*a–c*) arranged one after the other and provided with screening elements (17–18), said component screens being arranged with successively decreasing inclinations relative to the horizontal plane, said vibrator mechanism (3) being arranged to impart to said screen body (2) directional oscillating movements which impart to said material lifting or throwing movements obliquely forwards and upwards in a direction towards said discharge end (9), at least one said component screen in a lower screen deck having a greater inclination in relation to the corresponding component screen of the nearest deck above.

2. A vibrating screen in accordance with claim 1, wherein said component screen (14*c*, 15*c*, 16*c*) which in each of said screen decks (11–13) is closest to said discharge end (9), is longer than the other component screens (14*a–b*, 15*a–b*, 16*a–b*) in said deck.

3. A vibrating screen in accordance with claim 2, wherein the component screen which is closest to said discharge end is at least 50% longer than the other component screens in the respective deck.

4. A vibrating screen in accordance with claim 1, wherein all said screening elements (17–19) of said screen decks are tensioned in the longitudinal direction of said oblong screen body (2), said screen decks including middle screening components which are spaced from the feed and discharge ends of the screen body, said screening element of a middle screening component being tensioned with the help of a tensioning device comprising tensioning members (32) arranged at said feed end, each said tensioning member being flexibly connected by an extension member (34) to a pulling member (35) which is guided in a predetermined pulling direction by guides (37, 38) and is fixedly connected to a tensioning element (24) which is hooked on to a hooking member (20) at the end of said screening element (18).

5. A vibrating screen in accordance with claim 4, wherein a flexible connection member (39) which transmits tensioning force from said extension member (34) to said pulling member (35) is located lower than a point of engagement between said tensioning element (24) and said hooking member. (20) and is provided with a guide member (36) engaging said guides (37, 38), said tensioning force thereby resulting in a jamming effect between said guide member and guides.

6. A vibrating screen in accordance with claim 4 wherein the tensioning members are tensioning screws.

7. A vibrating screen in accordance with claim 1, wherein at said feed end (7) of said screen removable covers (40) are provided at each said lower screen deck or decks (11–13) substantially at right angles to the inclination of said decks, said covers also supporting spillage protection plates (41) arranged to prevent spillage of material between one end of the respective said screening element (17) and said cover.

8. A vibrating screen in accordance with claim 1, wherein there are three or more screen decks (11–13).

9. A vibrating screen in accordance with claim 1, wherein said component screens of each said screen deck are arranged in steps so that the end portions of adjoining component screens are located at a vertical distance from each other, a turnover movement thereby being imparted to the material transported along a said screen deck when said material is transferred from one component screen to another.

10. A vibrating screen in accordance with claim 9, wherein said adjoining component screens of a said screen deck overlap each other a distance in the horizontal plane.

11. A vibrating screen in accordance with claim 1, wherein the screening elements are formed of metal wire cloth.

12. A vibrating screen in accordance with claim 1, wherein the screening elements are formed of nettings.

* * * * *